United States Patent [19]

Mercer

[11] 4,296,654

[45] Oct. 27, 1981

[54] ADJUSTABLE ANGLED SOCKET WRENCH EXTENSION

[76] Inventor: Albert E. Mercer, Box 531, Jacumba, Calif. 92034

[21] Appl. No.: 68,097

[22] Filed: Aug. 20, 1979

[51] Int. Cl.[3] ..... B25B 17/00

[52] U.S. Cl. ..... 81/57.26; 81/57.31; 74/417

[58] Field of Search ..... 81/57.26, 57.31; 74/417; 145/75, 76

[56] References Cited

U.S. PATENT DOCUMENTS

| | | | |
|---|---|---|---|
| 149,587 | 4/1874 | Kyle | 145/75 |
| 2,106,937 | 2/1938 | Torbert | 74/417 |
| 2,348,266 | 5/1944 | Selby | 74/417 |
| 2,791,142 | 5/1957 | Lyon | 81/57.26 |
| 3,022,675 | 2/1962 | Trought | 74/417 |

*Primary Examiner*—James L. Jones, Jr.
*Attorney, Agent, or Firm*—Ralph S. Branscomb

[57] ABSTRACT

A jointed drive unit is provided having a power output shaft used for driving a socket or the like, and an input shaft which transmits power to the output shaft through a gearbox permitting any angular orientation between input and output shafts greater than about 20°. The mechanism is more than merely a gearbox for transmitting rotational motion at an acute angle because due to the gear arrangement and a ratchet mechanism incorporated in the preferred embodiment the output shaft can be made to rotate, not only by rotating the input shaft, but also by pumping the input shaft in a plane parallel to the output shaft, or alternatively, moving the input shaft back and forth in a plane perpendicular to the output shaft in conventional open end or box end ratchet wrench fashion.

8 Claims, 8 Drawing Figures

ADJUSTABLE ANGLED SOCKET WRENCH EXTENSION

BACKGROUND OF THE INVENTION

The invention is in the field of universal joints as applied to hand tools and also hand tool drive mechanisms.

Probably one of the most difficult and frustrating tasks of a mechanic, especially an automobile or vehicle mechanic, arises in trying to gain access for mounting or removal of bolts, screws, and the like, which require rotation, from a motor or other piece of machinery whose design criteria may have included adaptability to swift assembly on the assembly line, and perhaps compactness and the ability to interfit with other closely spaced equipment and installation, but there having been given little or no thought by the designing engineers to accessibility of parts and bolts for removal and repair during the routine maintenance which is bound to come up over the life of the machine.

Access and removal of a bolt, for example, can sometimes be attempted from a direction perpendicular to the bolt shaft with an open end wrench. Not infrequently the wrench head can be inserted from this direction to grip the bolt, but inadequate back and forth space exists to manipulate the wrench and remove the bolt.

Another typical variation of the above-mentioned dilemma arises when the bolt must be accessed from an angle slightly to the head side of perpendicular to the bolt length so that an open end wrench will continually slip off the bolt head but the angle is too steep for proper removal with a socket wrench, even one having a universal joint head, as these are typically impractical at angles of greater than about 60°.

There is a need for a wrench having a jointed head which will fit snugly and orthogonally over any accessible bolt head and which can be moved either linearly or rotationally in any direction at all in the machinery in which there is freedom to move and still cause the bolt in question to be removed or installed as the situation requires.

SUMMARY OF THE INVENTION

The present invention fulfills such a need through the utilization of a novel gear implementation in which the input or drive shaft and the output or driven shaft both have bevel gears on their connected ends which mesh in facing bevel gears articulated in a unitary gear spool. This arrangement permits the driven shaft to rotate in the same direction as the driving shaft, and by utilizing different diameter gears in the gear spool, permits the preselection of driving to driven mechanical advantage.

A mechanism comprises the gear housing which is made up of a pair of pivotally connected mounting brackets which support the two shafts so that the two shafts may be freely angularly adjusted as though connected by a knuckle joint provided that during the angular adjustment at least one of the shafts is free to rotate. If, for example, the driven shaft mounts a socket which is engaged on a bolt, angular adjustment of the driving shaft without permitting its rotation about its longitudinal axis will result in the expression of a torque on the bolt in question. In other words, a pumping action exerted on the input or driving shaft will cause reciprocating rotational forces to be exerted on the output shaft, and the incorporation of a ratchet will interpret reciprocating input pumping into periodic unidirectional rotational force at the output.

By maintaining the two shafts at the same angular orientation and rotating the input shaft, the output shaft is rotated and the effect of a universal joint transmission, or a drive that is expressed at a different angle from the input, is achieved.

In addition to the driving of the output shaft which is achieved by pumping, or alternatively, by rotating the input shaft, a third motion of merely moving the input shaft in a direction having a component orbitally directed of the longitudinal axis of the output shaft will also rotate the output shaft. In other words, when the instant drive mechanism is implemented with a socket in a socket wrench application, once the socket is engaged on a bolt and the ratchet is set for either the removal or installation of the bolt, no matter what motion is applied to the input shaft, either rotational or translational in any direction, the output is the properly directed unidirectional force at the output so that regardless of what shape an access space may be on a particular machine on which the user is working, if there is clearance to move in any direction, or rotationally, bolts may be removed and installed.

DETAILED DESCRIPTION OF THE PREFERRED EMBODIMENT

Figure 1:
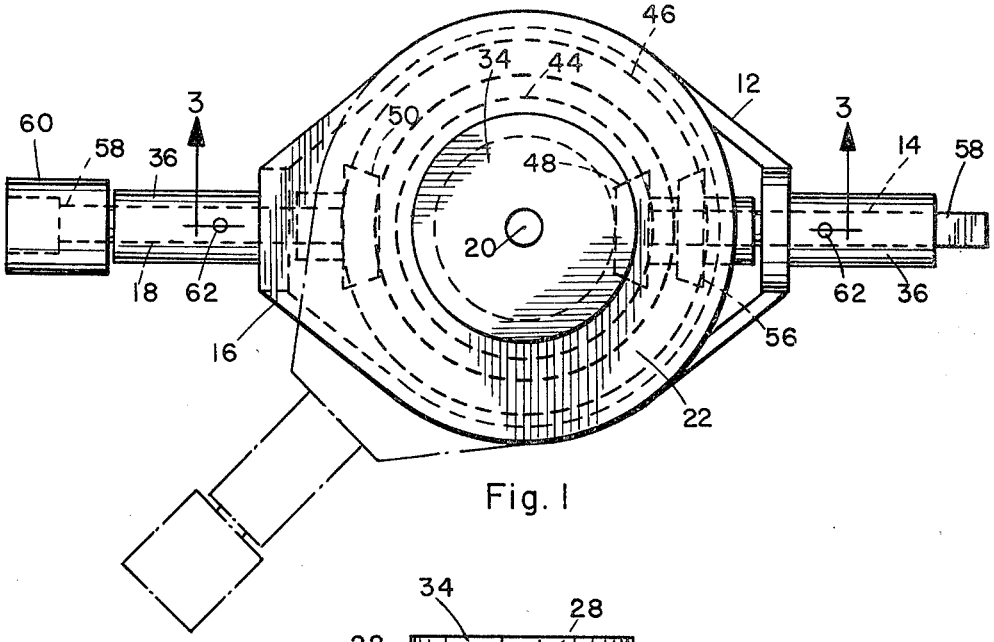
FIG. 1 is a top plan view of the basic drive mechanism.
Figure 2:
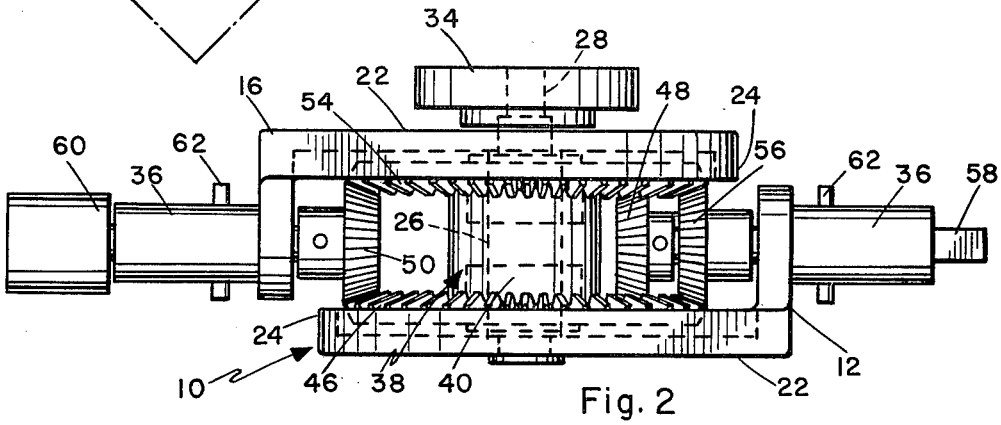
FIG. 2 is a side elevation view of the mechanism.

The gear housing, generally indicated at 10, comprises a pair of identical mounting brackets, one shown at 12 for the input or drive shaft 14 and the other at 16 which mounts the output shaft 18. It is essential to the invention that these two brackets are angularly adjustable relative to one another about an axis shown at 20 and it is preferred that their shape be such that the two shafts 14 and 18 can be swung together in the direction shown in phantom in FIG. 1 to strike an angle that is as acute as possible.

Therefore, the mounting brackets, each of which includes an end plate 22 and a sidewall 24 are shaped so as not to conflict when the shafts are moved together.

The brackets are spaced apart by a cylindrical sleeve 26 and held together by a bolt 28 having a retainer ring 30 which provides adequate spacing to allow free, and even somewhat loose, rotational movement of the brackets about the axis 20. The end of the bolt is threaded as at 32 and thereupon is engaged a locking knob 34 which for reasons that will become apparent, can be used to tighten down and compress the end plates 22 of the mounting brackets together and against the sleeve 26 to freeze them in a particular angular orientation about the axis 20. However, in their ordinary mode of deployment, the two brackets would be free to swing back and forth about the axis 20 subject to the restraining forces caused by the gear structure detailed hereinafter.

The brackets 12 and 16 establish the parameters of movement of the shafts 16 and 18 which are journaled in extended reinforcing shanks 36 so that the shafts rotate freely and swing freely in the arc indicated in FIG. 1. Beyond the establishment of this relationship, there is fairly wide latitude in the design possibilities of brackets, including making them narrow and yoke-like or expanding them by extending the sidewalls 24 such that they completely enclose the interior gear structure, leaving only a circumferential sliding seam exposed to the exterior environment.

Turning now to the interior gear structure, within the gear housing 10, a gear spool 38 is rotational in the sleeve 26 about the axis 20. This spool may clearly take a variety of forms but for clarity of illustration in the illustrated embodiment comprises a central cylindrical sleeve 40 which integrally connects by means of pins 42 or other rugged load-bearing means of attachment an upper bevel gear 44 and a lower bevel gear 46. These bevel gears face each other, and it is emphasized that they are integral so they rotate together but do not have an independent motion capability. Clearly the lower gear is of larger outside diameter than the upper.

The inner end of the input shaft 14 rigidly mounts another bevel gear 48 which is maintained by the shaft mounting bracket 12 in meshed relation with the upper bevel gear 44, and a corresponding bevel gear 50 is rigidly mounted on the inner end of output shaft 18 in meshed relation with the lower bevel gear 46. The rigid nature of attachment of these gears is indicated by their mounting pins 52 to distinguish them from idler gears discussed below.

It can be seen now that upon application of a rotational movement to the input shaft 14 a rotational force is delivered through gear 48, gear 44, the central sleeve 40 of the gear spool, and then delivered through the lower bevel gear 46 to the gear 50 of the output shaft causing output shaft 18 to rotate in the same direction as the input shaft 14 but at a multiplied angular velocity due to the variation between the diameters of the upper and lower bevel gears 44 and 46.

The above stated gear structure is actually mechanically adequate in theory to effectuate the aims of the instant tool, in fact, it could be simplified even further by omitting the upper bevel gear 44 and driving both of the gears 48 and 50 from the lower gear 46. This would serve to eliminate one gear but would have the disadvantage of causing the output shaft to rotate in the opposite direction from the input shaft and would eliminate the automatic mechanical advantage or speed advantage feature inherent in the use of different sized transmission gears 44 and 46 (although of course this could be replicated by the variation of the size of one of the gears 48 or 50).

However, for purposes of strength, it is desirable that certain idler gears be added to the mechanism to offset lateral forces experienced by the gears involved in the driving force transmission. Obviously, these forces could be rather high due to the nature of the use of the tool.

In the illustrated embodiment lateral forces are offset by means of a free-wheeling idler gear 54 which engages both the fixed gear 50 to counteract lateral thrusts against the output shaft and also engages free-wheeling idler 56 to balance the forces on the input shaft.

Figure 3:
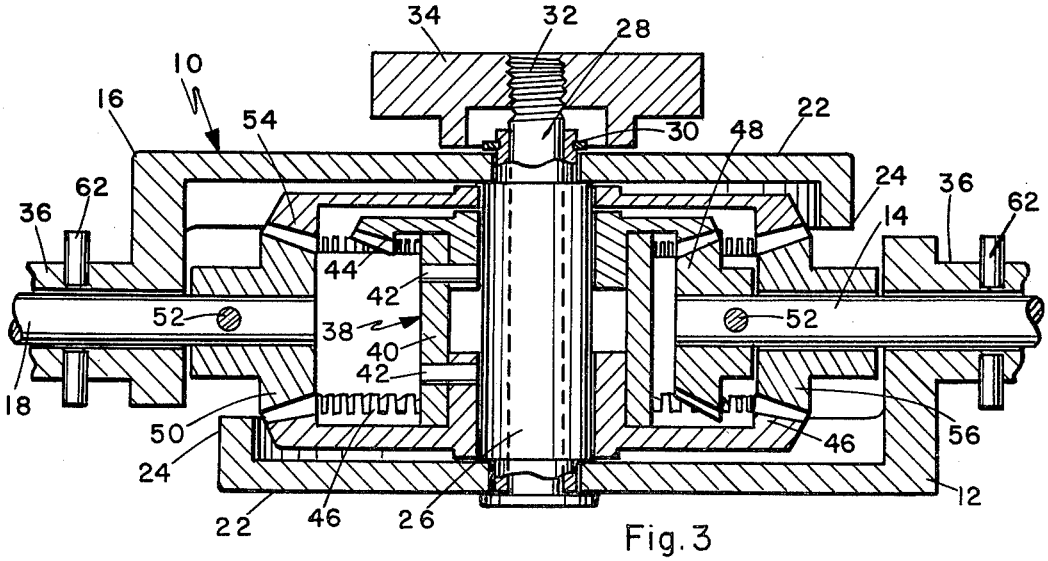
FIG. 3 is an enlarged sectional view taken on line 3—3 of FIG. 1.

In the course of the instant description, clarity has been achieved by referencing the two shafts and their collateral structure as input or drive shaft and output or driven shaft. However, as is best seen from FIG. 3, externally the shafts are essentially identical, terminating in a squared-off head 58 which can be used to engage either a socket 60, some other driving head, such as a screwdriver, or a manual or mechanical drive mechanism. In other words, the input shaft can actually be switched and used as the output shaft with the output shaft being driven. The significance of this, of course, is the conversion of the rotational speed multiplying feature of the device as described in the orientation of FIG. 3 into a mechanical advantage.

Turning now to means of driving whichever shaft is elected as the input shaft for a particular use, each of the reinforcing shanks 36 mount trunnion-like pins 62.

These pins, or the equivalent structure, provide a fixed reference for the attachment of structure which juxtaposes with the rotating chuck 58. By selectively permitting or not permitting rotating of the chuck 58 inside the shank 36 as the shaft rotates about the axis 20, different effects can be achieved at the output shaft.

Figure 4:
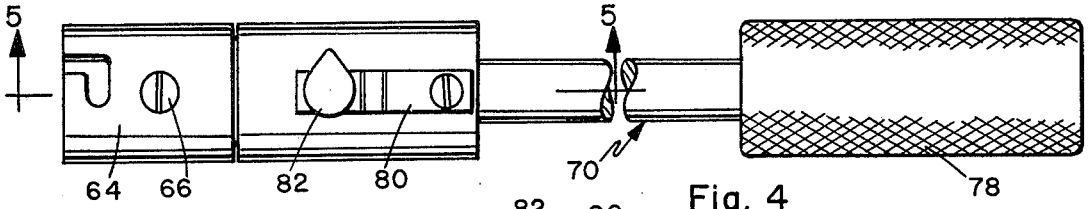
FIG. 4 is a top plan view of a ratchet handle for actuating the mechanism.
Figure 5:
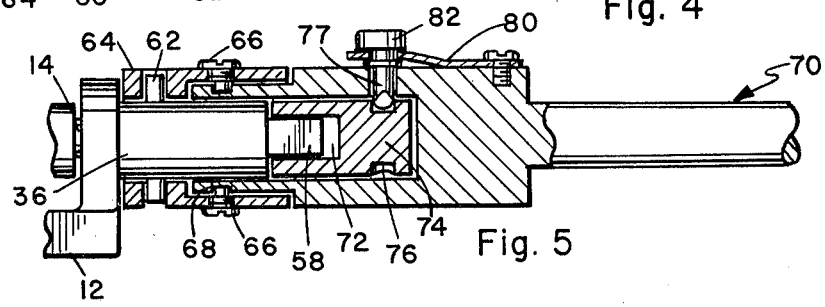
FIG. 5 is a sectional view taken on line 5—5 of FIG. 4 showing the ratchet handle attached to the drive mechanism.

Turning specifically to the structure of FIGS. 4 and 5 it can be seen that a slotted sleeve 64 has been engaged on the trunnion pins 62 of the shak 36 and that this sleeve mounts keys 66 riding in the annular keyway 68 of a ratchet handle 70 so that the ratchet handle is permitted to rotate freely about the shank while being retained thereon.

The attached end of the ratchet handle 70 defines a re-entrant cylindrical cavity 72 to accommodate a cylindrically surfaced insert 74 which has a square bore to engage the chuck 58. This insert defines an annular row of detent hollows 76 which cooperate with the spring-biased pawl 77 so that a ratcheting action is achieved in the end between the rotating input shaft 14 and the outer non-rotating structure of the tool including the reinforcing shank and the shaft mounting bracket. The handle includes an extended grip 78 and the leaf spring 80 which provides the biasing force against the pawl 77 and by pulling out the pawl pin by its directional indicator knob 82 and rotating it 180°, the direction of ratcheting can be reversed.

Figure 8:
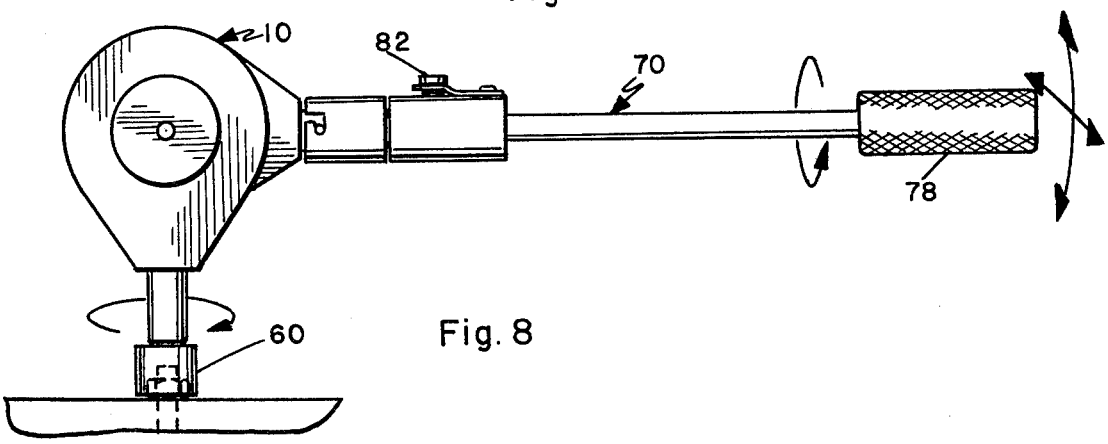
FIG. 8 is a side elevation view of the mechanism in use displaying the three modes of operation.

The operation of the tool with this ratcheting handle mounted to it is as follows. The ratchet handle can be rotated either unidirectionally or in a reciprocating fashion, and a unidirectional motion will be delivered to the output shaft. In addition to this mode of motion, as seen in FIG. 8, by virtue of the incorporation of the ratchet assembly, the handle can be moved up and down in a pumping action, and still a unidirectional rotation will be applied to the output shaft. Lastly, the handle can be moved back and forth in a horizontal plane, just as one would use a ratcheted box end wrench, to achieve the same motion. In addition to these three motions, it is clear that any combination of them is going to result in the rotation of the output shaft so that, for example, when trying to remove a bolt from a very tight space any slight motion which the space permits, whether it be back and forth or even around in a circular arc will cause the removal of the bolt. The single ratchet mechanism is effective for any of the three input motions and any combination of the three.

The ratchet handle 70 is exemplary in nature as clearly other ratchet mechanisms could be used to achieve the same effect. For example, a ratchet could be incorporated directly in the gear housing 10 in one of the gears 48 or 50, although the preferred embodiment clearly would indicate an easier means of access and ratchet reversal. Also, an arrangement wherein the gears 44 and 46 alternately move in and out to alternately engage input gear 48 could be implemented, or an axially movable bevel gear 48 could be used to achieve the same result as a ratchet mechanism without requiring one.

Figure 6:
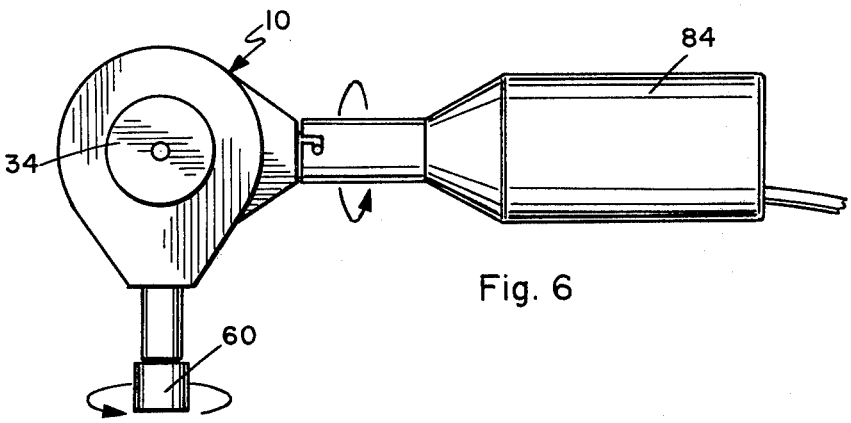
FIG. 6 illustrates the drive mechanism with a rotary power unit atached.
Figure 7:
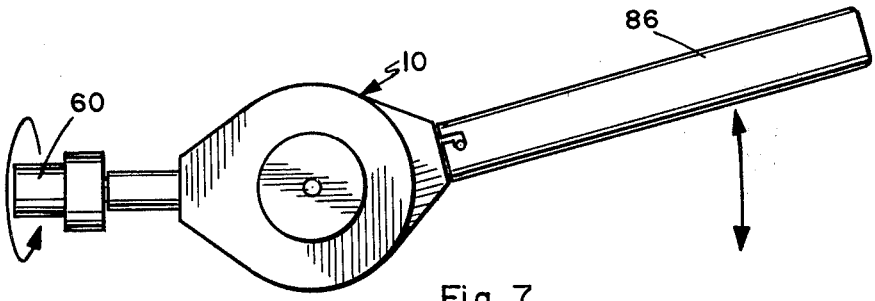
FIG. 7 illustrates the drive mechanism operated by a swinging action.

Provision could be provided such as bore through the handle 78 for the insertion of a torsion bar, and a power driver such as a pneumatic or electrical unit, could be used as indicated at 84 in FIG. 6. Lastly, a straight handle 86 could be used having an interior structure locking the chuck 58 against The rotation inside the shank 36 so that the ratcheting is eliminated and a straight drive is provided.

Because of the multiple possible drive movements capable in the device, its principal utility is in the field of socket wrenches, screwdrivers, and other similar tools which are used to deliver a rotational motion to a tight space.

However, as is set forth in detail in a co-pending application, the same basic mechanism can be utilized as a motive power drive mechanism, for example, in wheelchairs and other vehicles where the translation of reciprocating motion such as hand movements into rotational movement of a wheel is desired.

Remote handling devices capable of positioning a probe or gripping element, stationarily or rotationally, at any point in three dimensional space, can be achieved by coupling two of the instant devices in series with collateral control systems to separately select whether the master rotational input is delivered as a rotational or swinging arm output to the first and second gear units. Because the instant units are simply polar coordinate analogues the system could easily be computer operated in an automated implementation.

What is claimed is:

1. A tool drive mechanism for producing a rotational motion at an output shaft from a selectable motion at an input shaft, said drive mechanism comprising:

(a) an input shaft mounting bracket having said input shaft captured in journaled relation therein such that said shaft is rotational about its longitudinal axis;

(b) an output shaft mounting bracket having said output shaft captured in journaled relation therein, such that said shaft is rotational about its longitudinal axis;

(c) said mounting brackets being pivotally interconnected to define an axis of angular adjustment perpendicular to the rotational axes of said shafts and permitting relative pivotal motion of said shafts in their respective brackets in a common plane substantially including the shafts;

(d) each of said shafts having a pivotally inner end mounting an integral bevel shaft gear captured by the mounting bracket which mounts same;

(e) a gear spool rotational between said brackets about said axis of angular adjustment and defining two inwardly facing bevel gears engaging respective ones of said shaft gears whereby clockwise rotation of one of said shafts about its longitudinal axis produces clockwise motion of the other of said shafts about its longitudinal axis such that rotation of a first one of said shafts can be selectable caused by either the rotation of the other shaft about its longitudinal axis, or the non-rotational pivoting of the other shaft about said axis of angular adjustment, or the non-rotational pivoting of the other shaft about the longitudinal axis of said first one of said shafts;

(f) each of said shaft gears, on the side thereof opposite the side engaging the respective inwardly facing bevel gear, engaging a gear in idling relation; and, (g) one of said shafts having an idler gear journaled thereon engaging the inwardly facing bevel gear which engages a shaft gear of the other of said shafts, and the last-mentioned gear engaging an inwardly facing idler beveled gear journaled coaxiálly with the first-mentioned two inwardly facing beveled gears.

2. The structure according to claim 1 wherein said two inwardly facing bevel gears defined by said gear spool are of different radii such that a mechanical advantage other than one is established between said two shafts.

3. The structure according to claim 1 wherein said two mounting brackets are each expanded to define end caps together defining a flattened, generally disc-shaped substantially enclosed gear housing.

4. The structure according to claim 1 and including a ratchet mechanism defined between said input shaft and input shaft mounting bracket to selectively limit the motion of said output shaft to clockwise or counterclockwise unidirectional rotation regardless of the plane of pivoting, or the direction of rotation, of said input shaft.

5. The structure according to claim 4 and including a rigid sleeve mounted to said input shaft mounting bracket and extending over said input shaft such that the latter is rotational within said sleeve, and said ratchet mechanism is operative to engage said input shaft relative to said sleeve.

6. The structure according to claim 5 wherein said sleeve is part of a handle containing said ratchet mechanism and said handle is releasibly attached to said mounting bracket.

7. The structure according to claim 1 wherein said two mounting brackets are interconnected in spaced relation by a bolt passing therethrough and traversing a hollow spacer cylinder and including means for locking said mounting brackets together at a selected orientation comprising a threaded knob engaged on one end of said bolt to draw said brackets into frictional engagement with said cylinder.

8. Structure according to claim 1 wherein said input shaft has an extended end at least partially non-circular in cross section so that it may be gripped for rotation, and said bracket defines a shank extending partially over said input shaft in the direction away from said gear spool, and said shank defines means for engaging same such that a handle may be inserted over and into positive engagement with said input shaft and said shank for the control of the mutual rotation therebetween.

* * * * *